United States Patent [19]

Meschi

[11] Patent Number: 4,491,259

[45] Date of Patent: Jan. 1, 1985

[54] DEVICE FOR THE AUTOMATIC POSITIONING OF STRIPS OF SHEET MATERIAL

[75] Inventor: Luciano Meschi, Leghorn, Italy

[73] Assignee: Wully S.A., Panama

[21] Appl. No.: 356,333

[22] Filed: Mar. 9, 1982

[30] Foreign Application Priority Data

Mar. 10, 1981 [IT] Italy ..... 21033/81[U]

[51] Int. Cl.[3] ..... B65H 17/38

[52] U.S. Cl. ..... 226/74

[58] Field of Search ..... 226/74, 75, 170, 6, 226/52; 271/34, 35; 242/58.1; 156/507, 508, 506; 400/613.1, 613.2, 616, 616.1, 616.2, 616.3

[56] References Cited

U.S. PATENT DOCUMENTS 3,169,896 2/1965 Dresser ..... 156/507
3,870,584 3/1975 Jores et al. ..... 156/507 X
3,935,056 1/1976 Koyama et al. ..... 156/507
4,226,353 10/1980 Blaskovic et al. ..... 226/74

FOREIGN PATENT DOCUMENTS 686603 5/1964 Canada ..... 242/51.8
620733 4/1927 France ..... 271/35

OTHER PUBLICATIONS

IBM Technical Disclosure, "Document Feed with Metering Device", G. D. Herring, Jan. 1963.

*Primary Examiner*—Billy J. Wilhite
*Assistant Examiner*—Scott J. Haugland
*Attorney, Agent, or Firm*—McAulay, Fields, Fisher, Goldstein & Nissen

[57] ABSTRACT

An automatic positioning device for sheets or forms to be spliced comprising a casing in which the sheets to be spliced are advanced so that the edges to be spliced are exactly aligned with each other.

14 Claims, 3 Drawing Figures

DEVICE FOR THE AUTOMATIC POSITIONING OF STRIPS OF SHEET MATERIAL

The present invention relates to a device for the automatic positioning of strips of sheet material, particularly strips of forms, which are fed to an apparatus for automatic splicing.

It is known that in both electronic accounting and data processing centers, sheets and forms are used in the form of continuous strips. The strips are formed by folding the sheets and forms so as to create a package.

In the aforesaid centers the forms are processed at a very high rate, exceedingly high values being achieved with so-called laser printing machines. Therefore, a form package is exhausted and thus consumed in very short time. Consequently a large amount of non-productive time is necessitated by the need to re-start the feeding of forms from a new package. This seriously affects the operating speed and thus the production rate of the centers, at an incidence sometimes higher than 50%. This problem already has been faced and solved by the Applicant by means of an apparatus for the automatic splicing of sheet material (disclosed in the European Application No. 81 104 840.4) in which the last sheet of the package already feeding the data processing apparatus and the first sheet of another package are approached to each other along the edges to be spliced onto a splicing plane, whilst a splicing head applies a strip of adhesive ribbon along the splicing line, presses against the adhesive face of the ribbon the areas of the already approached forms to be spliced and trims the edges of the splicing.

One object of the present invention to provide a device for the automatic positioning to each form onto the splicing plane. It is evident that by means of such a device the splicing operation can be further automated and, a further reduction of the non-productive time can be achieved.

This object is fulfilled with a device for the automatic positioning of the sheet to be spliced onto a splicing plane with the edges to be spliced to each other exactly aligned, characterized by the provision of a casing having a removable cover plate, which, in the operating position, forms with the casing an inlet slit and an outlet slit, means for advancing the sheet or form being provided in said casing, said means having sheet or form engagement means. The device further includes, upstream of said sheet advancing means, means for the initial positioning of the sheet or form with respect to said advancing means.

According to the preferred embodiment of the invention, said cover plate is overturnable with respect to the casing, the latter being of the box type, and said advancing means consists of a pair of conveying belts, from the outer surfaces of which pins or teeths protrude which are capable of engaging the holes normally provided along the opposed longitudinal edges of the sheets or forms, said conveying belts being actuated for an intermittent advancement.

The particular features and the advantages of the present invention shall be more clearly understood from the following detailed description and by reference to the enclosed drawings, in which.

Figure 1:
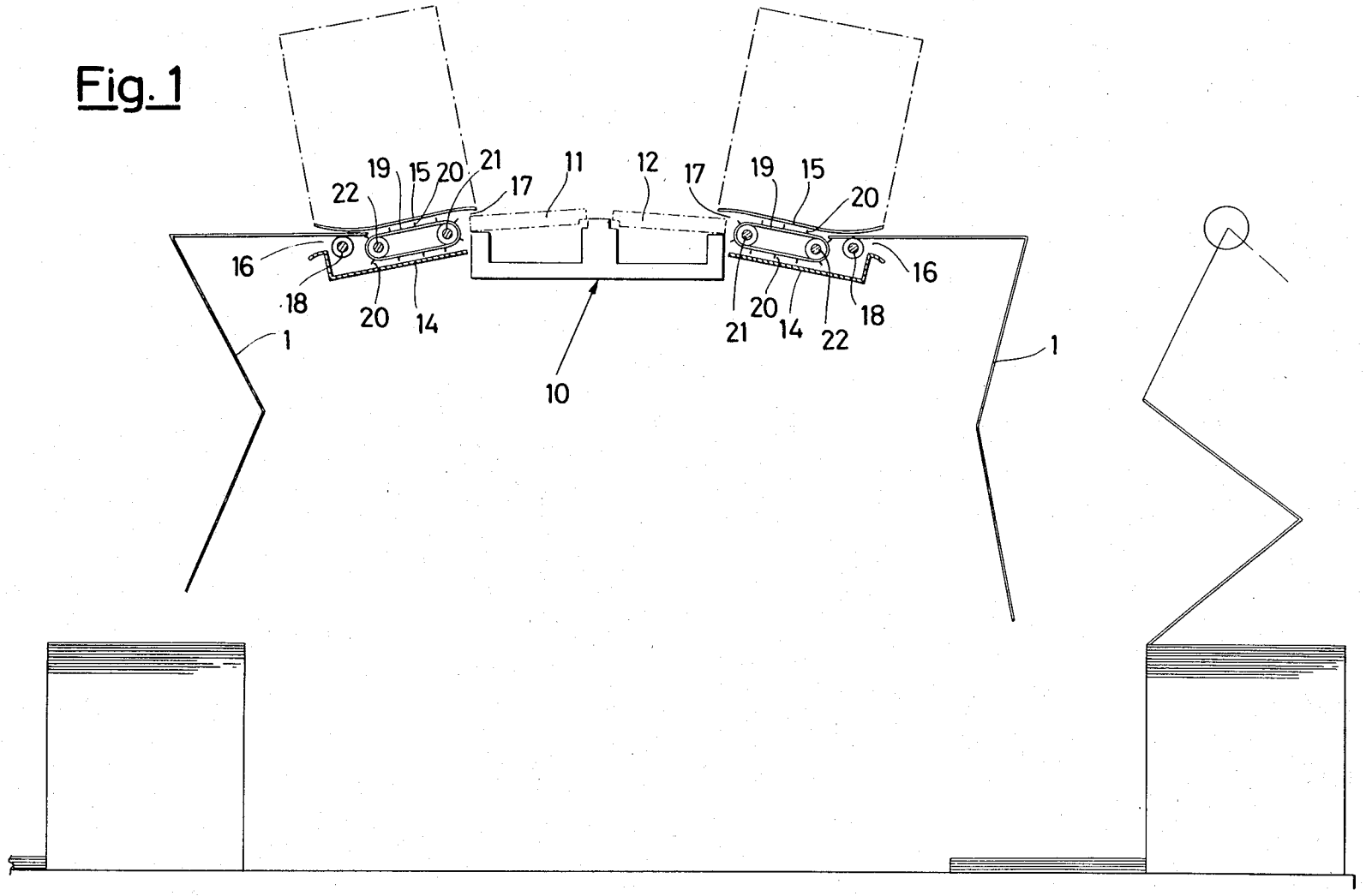
FIG. 1 is a schematic side view of the device according to the invention in combination with a splicing apparatus of the type described in the aforementioned patent Application.
Figure 2:
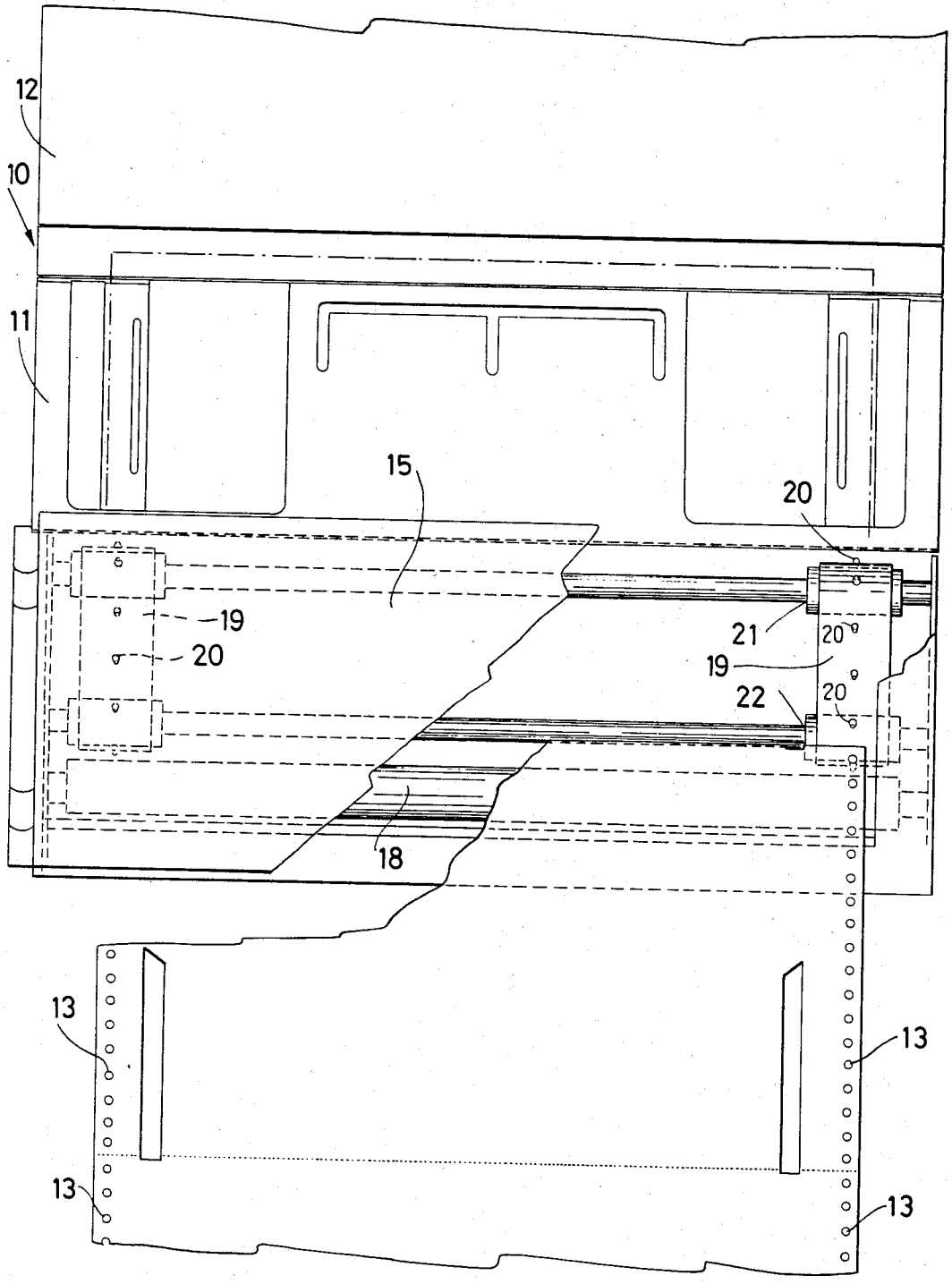
FIG. 2 is a plan view, from above and partially in cross-section, of the device of FIG. 1 with respect to only one splicing half plane.

Referring to the drawings, the reference numeral 10 denotes a splicing plane, comprising two half planes 11 and 12, which are movable between a splicing position, and a position of preliminary approaching of the forms 1 to be spliced, shown by dashed lines in FIG. 1.

The sheet or form 1 to be positioned onto the related half plane 11, is provided with the usual holes foreseen for the use in electroaccounting and data processing machines.

Figure 3:
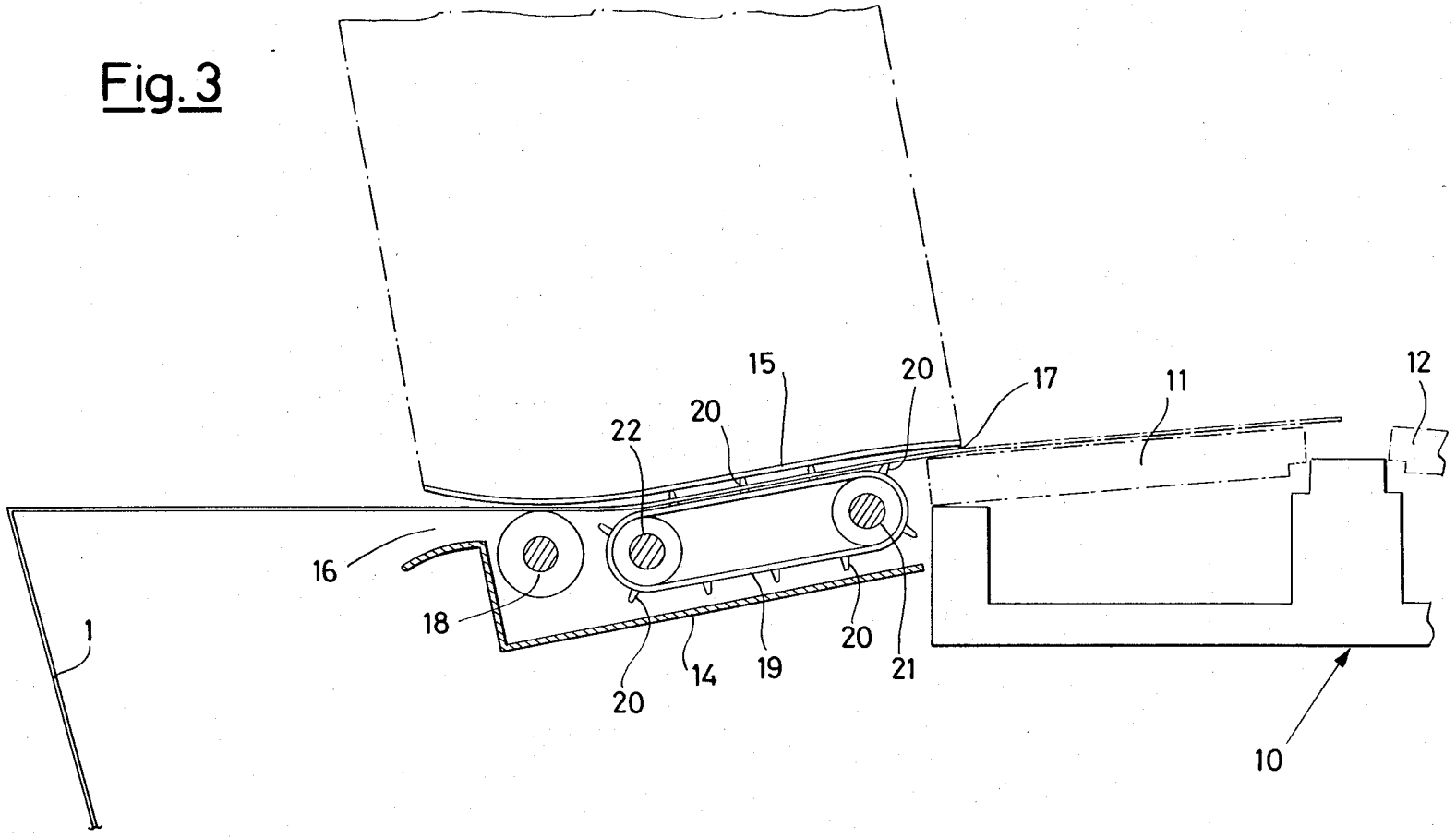
FIG. 3 is a view analogous to FIG. 1, showing the cover plate in its overturned position and with respect to only one splicing half plane.

For positioning of the sheet 1 onto the half plane 11, the device of the present invention is provided with a generally parallelepiped casing 14, having a closure or cover plate 15, hinged to the casing 14 along a longitudinal edge, so as to be movable between a first closed or operating position, and a second, open or upwardly turned position shown in FIG. 1 and FIG. 3 by solid and dashed lines respectively.

In the second position, the inner cavity of the casing 14 becomes accessible, and it is further possible to free the form, after it is spliced, from the positioning device.

In the closed position of the plate 15, it forms with the with fore and aft vertical walls of the casing 14 a slit 16 for the inlet of the form and a slit 17 for the exit of the form.

At the form inlet slit a friction roller 18 is provided, capable of interfering in a predetermined manner, with the pattern of the form or sheet and which engages said form or sheet for the positioning thereof with respect to the advancing means to be hereinafter described. It is evident that, instead of the friction roller 18, wheels having the same function and spaced from each other can be used.

A pair of conveying belts is provided for the advancing of the forms, inserted through the slit 16 and positioned by means of the friction roller. The belts have pins or teeths 20, protruding from their outer surface and positioned so as to correspond to the holes 13 of the form or sheet 1. The conveying belts 19 are driven by pairs of rollers 21 and 22, one of which is a driving roller and the other is a transmission roller, in the usual manner, for instance by means of an electric motor of the step by step type. It is evident that the exact positioning of the sheet or form 12 onto the respective splicing half plane 11, entails the cooperation of the advancing motion of the conveying belts 19 and the presence of the single cover extending along and across the belts to perform the positioning action. The foregoing elements permit the elimination of the form or sheet positioning pins or sheets of the splicing half plane.

According to a preferred embodiment, at the inlet slit side vertical members may be provided to make the introduction of the form or sheet in the inlet slit easier. Further, it is clear that the device of the present invention fully eliminates non-productive time due to the need for manual exact positioning of the form or sheet onto the respective half plane since the only possible manual operation is in the introduction of the form or sheet in the inlet slit 16.

Automatic means, controlled by the splicing apparatus and sequentially connected to the operating cycle thereof, which are adapted to control the displacement of the cover plate 15 between the said two operating positions thereof are usable. Said automatic means, can by way of example, include a pneumatic piston actuated to upwardly turn over the plate 15, when the splicing operation is completed and the splicing plane 10 is lowered to set free the spliced forms.

When the forms to be spliced are respectively the first and the last form of two form packages, the use of arms having sucking cups, of a per se known type, to transfer the two forms to be spliced to the inlet slits of the two positioning devices serving the two half planes 11 is possible.

As will be readily apparent to those skilled in the art, the invention may be used in other specific forms or for other purposes without departing from its spirit or central characteristics. The present embodiments are therefore to be considered as illustrative and not restrictive, the scope of the invention being indicated by the claims rather than by the foregoing description, and all changes which come within the meaning and range of equivalents of the claims are therefore intended to be embraced therein.

I claim:

1. A positioning device for the automatic positioning of form-sheets to be spliced onto a splicing plane, comprising:

a casing having vertical walls and including initial positioning means internally of said casing for initially positioning a form-sheet;

removable means including a cover plate adapted to close said casing, said means being movable between an operating position, in which access to the inside of said casing containing said positioning means is allowable and in which the form-sheet containable therein is freely removable; and form-sheet advancing means having members capable of engaging and dragging the form-sheet;

said initial positioning means being positioned upstream of said advancing means, for the initial positioning of the form-sheet with respect to said advancing means; and said casing enclosing said form-sheet advancing means, said cover plate being hinged along a side parallel to said form-sheet advancing direction and being movable between the operating position in which it forms, with said vertical walls of said casing, an inlet opening, an exit opening and a non-operating position in which it is rotated towards a position in which it permits free access to the internal members of the device and free removal of a form-sheet contained in the device, after the splicing operation is complete.

2. A positioning device according to claim 1, wherein said advancing means comprises a pair of parallel conveying belts with teeth protruding from their outer surfaces, to engage holes formed in the longitudinal edges of the form-sheets to be spliced, said belts being driven by rollers, respectively driving and transmission rollers, said driving rollers being intermittently actuated step by step.

3. A positioning device according to claim 1, wherein said means for the initial positioning consists of a friction roller adapted to interfere, at said inlet opening, with the pattern of the entering form-sheet.

4. A positioning device according to claim 3, wherein said advancing means comprises a pair of parallel conveying belts with pins protruding from their outer surfaces, so as to engage holes formed in the longitudinal edges of the form-sheets to be spliced, said belts being driven by rollers, respectively driving and transmission rollers, said driving roller being intermittently actuated step by step.

5. A positioning device for automatically positioning form-sheets to be spliced onto a splicing plane, comprising:

a casing including walls, and positioning means in said casing;

removable means including a cover plate adapted to close said casing, and said cover plate being hinged along a side parallel to the direction of advance of a form-sheet;

said removable means forming with said cover plate an inlet opening and an exit opening for a single form-sheet of said form-sheets;

said exit opening being aligned with and substantially coplanar with the surface of said splicing plane;

said removable means being movable between an operating position in which said inlet and exit openings are delimited and a non-operating position to permit access to the inside of said casing, the form-sheet being containable in said casing and being freely removable therefrom;

form-sheet advancing means including members for engaging and dragging the form-sheet;

said cover plate being movable between the operating positioning in which it forms with the vertical walls of said casing said inlet and exit openings and the non-operating position in which it is rotated towards a position in which it permits free access to the internal members of the device and free removal of a form-sheet contained in the device after splicing operation is completed; and means for the initial positioning of said form-sheet, said positioning means being positioned upstream of said advancing means for the initial positioning of the form-sheet with respect to said advancing means; and said casing enclosing said initial positioning means and said advancing means.

6. A positioning device according to claim 5, wherein said advancing means includes a pair of conveying belts having pins protruding from an outer surface thereof for engagement with holes formed in the longitudinal edges of the form-sheets.

7. A positioning device according to claim 5, including intermittently step by step actuated driving rollers, and transmission rollers for driving said belts.

8. A positioning device according to claim 5, wherein said advancing means comprises a pair of parallel conveying belts with teeth protruding from their outer surfaces to engage holes formed in the longitudinal edges of the form-sheet to be spliced, said belts being driven by driving and transmission rollers, said driving rollers being intermittently actuated step by step.

9. A positioning device according to claim 5, including a suction roller at said inlet opening for interfering with the pattern of the entering form-sheets.

10. A positioning device for automatically positioning form-sheets to be spliced onto a splicing plane comprising:

a casing and a cover plate adapted to close said casing;

removable means including said cover plate adapted to close said casing and forming therewith an inlet opening and an exit opening for a single form-sheet;

said exit opening being aligned with and substantially coplanar with the surface of said splicing plane;

said removable means being movable between an operating position in which said openings are delimited and a non-operating position to permit access to the inside of a positioning device, the form-sheet being containable therein and being freely removable therefrom;

form-sheet advancing means including members for engaging and dragging the form sheet;

said advancing means cooperating with said removable means to position and control said form-sheets; and means for the initial positioning of said form-sheet, said positioning means being positioned upstream of said advancing means for the initial positioning of the form-sheet with respect to said advancing means;

said casing enclosing said form-sheet advancing means and said initial positioning means;

said cover plate being hinged along a side parallel to the direction of the advance of the form-sheet;

said cover plate being movable between the operating position in which it forms with the vertical walls of said casing said inlet and exit openings and the non-operating position in which it is rotated towards a position in which it permits free access to the internal members of the device and free removal of a form-sheet contained in the device after splicing operation is completed.

11. A positioning device according to claim 10, wherein:

said advancing means includes a pair of conveying belts having pins protruding from an outer surface thereof for engagement with holes formed in the longitudinal edges of the form-sheets; and intermittently step by step actuated driving rollers, and transmission rollers for driving said belts;

said cover plate extending both along and across said conveying belts.

12. A positioning device according to claim 10, wherein:

said advancing means comprises a pair of parallel conveying belts with teeth protruding from their outer surfaces to engage holes formed in the longitudinal edges of the form-sheet to be spliced, said belts being driven by driving and transmission rollers, said driving rollers being intermittently actuated step by step; and said cover plate extends along or across said conveying belts.

13. A positioning device according to claim 10, including a friction roller at said inlet opening for interfering with the pattern of the entering form-sheets.

14. A positioning device according to claim 13 wherein said advancing means comprises a pair of parallel conveying belts each having pins protruding from their outer surfaces for engaging holes formed in the longitudinal edges of the form-sheets to be spliced and being intermittently step by step actuated by driving and transmission rollers.

* * * * *